US005396831A

United States Patent [19]

Marvin et al.

[11] Patent Number: 5,396,831

[45] Date of Patent: Mar. 14, 1995

[54] HYDRAULIC PLUNGER REPLACEMENT METHOD AND DEVICE

[75] Inventors: Lyle E. Marvin, Galena, Kans.; Dan Benson, Brighton, Mich.

[73] Assignee: Ingersoll-Rand Company, Woodcliff Lake, N.J.

[21] Appl. No.: 203,116

[22] Filed: Jul. 28, 1993

[51] Int. Cl.[6] ..... F01B 9/00

[52] U.S. Cl. ..... 92/29; 92/128; 403/324; 403/328

[58] Field of Search ..... 92/29, 128, 187, 255, 92/168; 403/328, 327, 326, 324

[56] References Cited

U.S. PATENT DOCUMENTS

| | | | |
|---|---|---|---|
| 1,902,261 | 3/1933 | Pilcher et al. | 92/29 |
| 2,853,347 | 9/1958 | Cooper, Jr. | 92/29 |
| 4,230,021 | 10/1980 | Aurousseau et al. | 92/29 |
| 4,768,944 | 9/1988 | Krebser et al. | 403/324 |
| 4,785,718 | 11/1988 | Hata et al. | 92/29 |
| 4,906,123 | 3/1990 | Weskamp | 403/328 |

FOREIGN PATENT DOCUMENTS

| | | | |
|---|---|---|---|
| 830940 | 8/1938 | France | 92/29 |
| 1213852 | 11/1959 | France | 403/328 |
| 835709 | 5/1960 | United Kingdom | 403/326 |

*Primary Examiner*—Thomas E. Denion
*Attorney, Agent, or Firm*—Walter C. Vliet

[57] ABSTRACT

A removable cartridge seal and dilatable collet retainer for a hydraulic plunger is provided to permit ready removal and replacement of the plunger and seal in a hydraulic intensifier device or the like.

5 Claims, 3 Drawing Sheets

HYDRAULIC PLUNGER REPLACEMENT METHOD AND DEVICE

BACKGROUND OF THE INVENTION

This invention relates generally to hydraulic systems and more particularly to an intensifier hydraulic system that has a hydraulic plunger seal that interfaces against a water plunger. In such systems, replacement of the hydraulic plunger seals or the water plunger requires removal of a cylinder end cap. This operation requires time and penetration of the hydraulic system which generally results in loss of hydraulic fluid and time-consuming cleanup.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an apparatus for releasably securing a piston rod to a shaft comprising a piston having a socket formed therein for receiving an axially disposed piston rod; the piston rod being provided with an expanded head for cooperative insertion in the socket; and the socket being further provided with radially expanding retention means selectively releasable by release means axially deployed along the piston rod.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
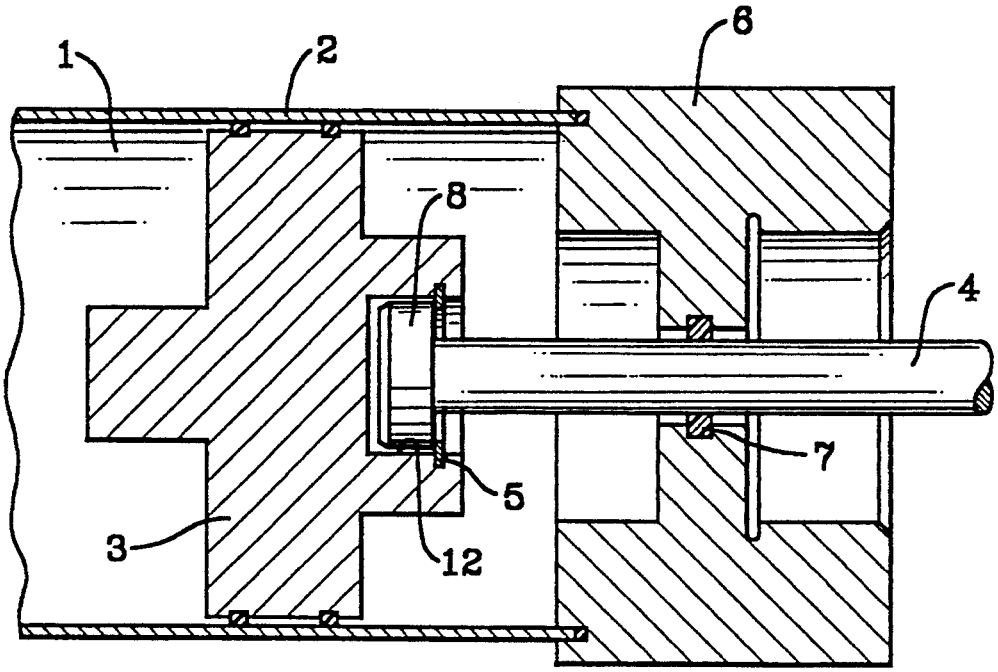
FIG. 1 (PRIOR ART)
FIG. 1 is a cross section of an intensifier hydraulic system according to the prior art.

Referring to FIG. 1, an intensifier hydraulic system is shown and generally indicated by the reference numeral

1. The intensifier is comprised of a hydraulic cylinder 2 having a hydraulic piston 3 disposed within its bore. A plunger 4 is cooperatively attached to the hydraulic cylinder 2 by means of a plunger head 8 disposed within a bore 12 within the piston by means of a retainer 5. The cylinder is closed off by an end cap 6 having a hydraulic plunger seal 7 disposed within a bore 14 of the end cap. The plunger 4 reciprocates with the hydraulic piston 3 during normal operation of the intensifier. It should be appreciated by one skilled in the art that disassembly of the end cap 6 is required to remove the plunger 4 from the hydraulic piston 3.

Figure 2:
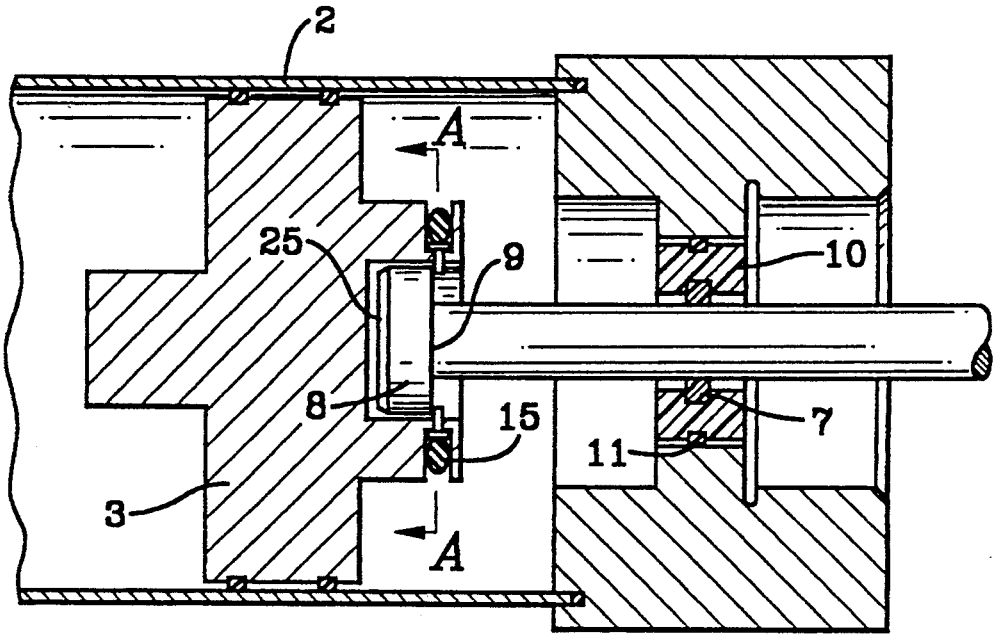
FIG. 2 is a cross section of an intensifier hydraulic system incorporating the releasable piston rod according to the present invention.
Figure 3:
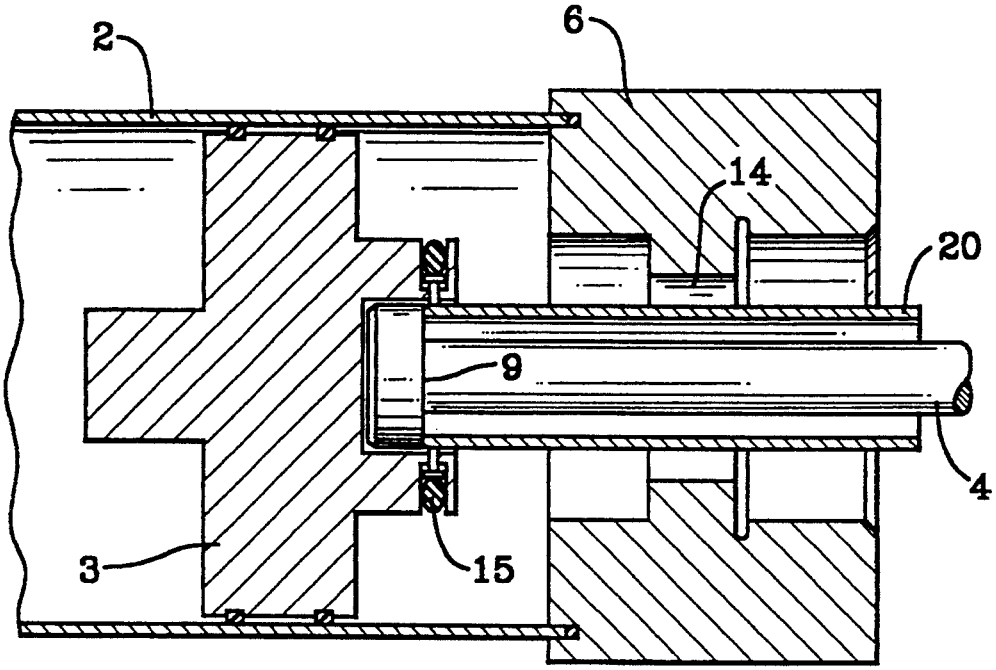
FIG. 3 is a cross section of an intensifier hydraulic system according to the present invention showing insertion of a water plunger removal tool to dilate the release collet.

Referring now to FIG. 2, according to the present invention the water plunger 4 and the hydraulic plunger seals may be replaced by providing a removable cartridge 10 containing the hydraulic plunger seal 7 and an end cap seal 11. The cartridge 10 may be retained within the end cap by any conveniently removable means such as thread engagement between the cartridge 10 and the end cap 6 or by means of a bolted flange connection or the like (not shown). The cartridge can be removed from the end cap by unscrewing (if secured by threads); by pressurizing the cavity between the hydraulic piston and the hydraulic piston 3 and the end caps 6 if secured by interference fit, or by threaded extraction tool(s) (jackscrews).

Once the cartridge 10 is removed, the seals may be replaced on the cartridge and the cartridge reinserted into the end cap 6. The cartridge also serves as a bushing to guide the plunger and as a structural element to react it against the hydraulic load. In addition to the removable cartridge seal, the water plunger may also be removed and replaced without disassembly of the end cap.

Referring to FIGS. 2, 3, 4, and 6, removal of the water plunger is obtained by providing the hydraulic piston 3 with an expandable collet retaining means 15. The engaged contracted collet 15 is shown in FIG. 2 reacting against a shoulder 9 on the plunger head 8 to retain the water plunger 4 in the hydraulic piston 3.

Figure 6:
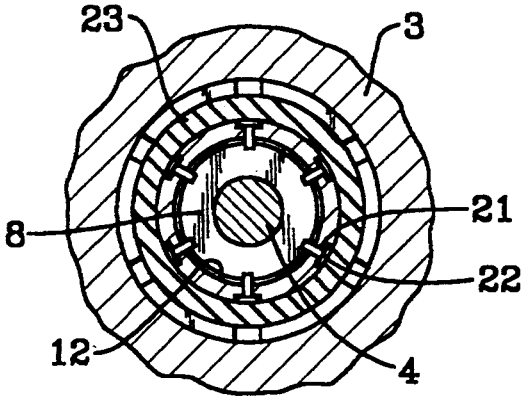
FIG. 6 is a cross section of the release collet taken at Section A—A of FIG. 2.

The construction of the expandable collet 15 is best understood by referring to FIG. 6. The head 8 of the water plunger 4 is retained within the bore 12 by means of a plurality of collet pins 22 disposed to project radially inward to contact the shoulder 9 of the plunger head thus preventing separation of the plunger 4 from the hydraulic piston. An "O" ring 23 is shown to maintain the collet pins 22 in the radially inward position depicted in FIG. 6. A circumferential spring or individual spring means or the like may be utilized to retain the collet pins 22 in the radially inward position shown as an alternative.

Disassembly of the water plunger 4 from the hydraulic piston 3 is accomplished by inserting a plunger removal tool 20 through the bore 14 of the end cap 6 and thereafter through the space vacated by the removed cartridge seal 10 to contact and expand the collet 15. The process is best understood by referring to FIGS. 3 and 4.

Figure 7:
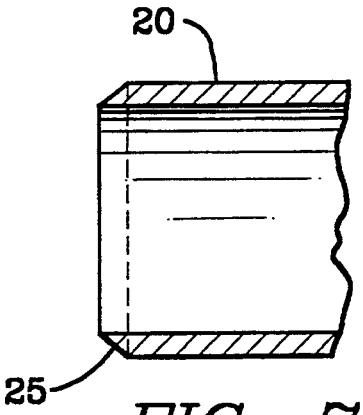
FIG. 7 is a partial cross section of a plunger removal tool which dilates the collet by axial insertion.
Figure 8:
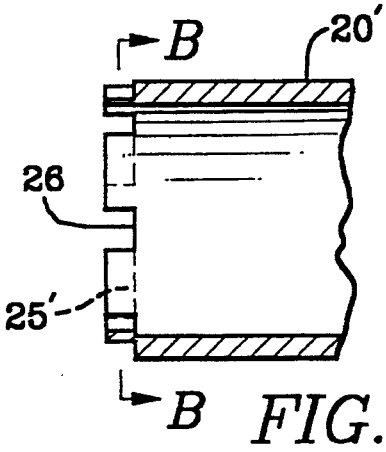
FIG. 8 is a partial cross section of a plunger removal tool which dilates the collet by axial insertion and rotation.
Figure 9:
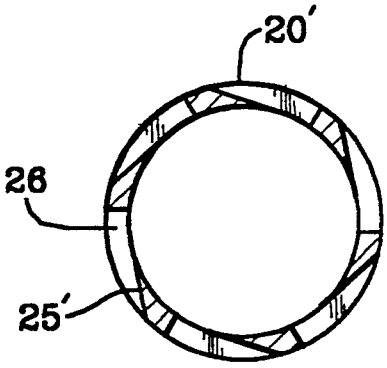
FIG. 9 is a cross section taken at Section B—B of FIG. 8.

The plunger removal tool 20 is provided with a beveled end 25 best seen in FIG. 7. The plunger removal tool is inserted through the end cap and into the piston retaining collet device 15. The collet is dilated by the tool either by inclined plane action along the tool axis or by cam action initiated by rotation of the tool using a castle ramp end 25' which is provided with a like number of end slots 26 to the number of collet pins 22 and in approximate circumferential registration therewith with each of the collet pins 22. Each of the slots 26 is further provided with a radially outward circumferential deploying ramp 25' best seen in FIG. 9.

Figure 4:
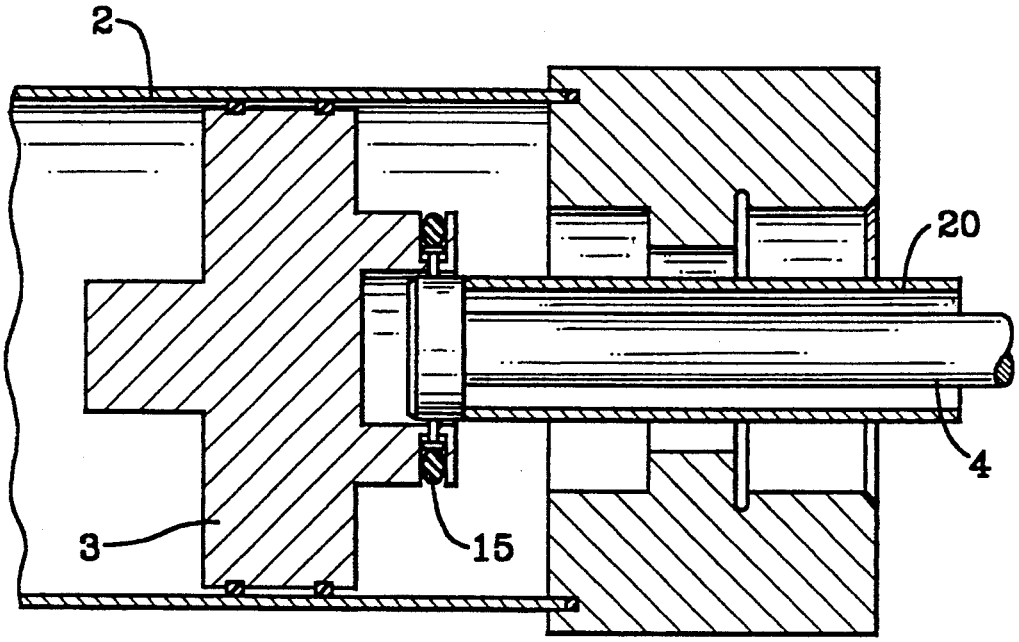
FIG. 4 is a cross section of an intensifier hydraulic system according to the present invention showing removal of the water plunger in progress.

The castle headed plunger removal tool 20' is inserted in the same manner as the plunger removal tool 20, however, instead of deploying the collet pins 22 radially outward upon axial insertion, the radial outward projection is accomplished by inserting the plunger removal tool 20' to a position wherein the collet pins 22 are surrounded by the slots 26. Thereafter the castle headed plunger removal tool 20' is rotated sufficiently to ramp the collet pins 22 out by means of the ramps 25'. It should be understood that either method accomplishes the dilation of the collet to permit removal of the water plunger 4 from the hydraulic piston 3 as shown in FIG. 4.

Figure 5:
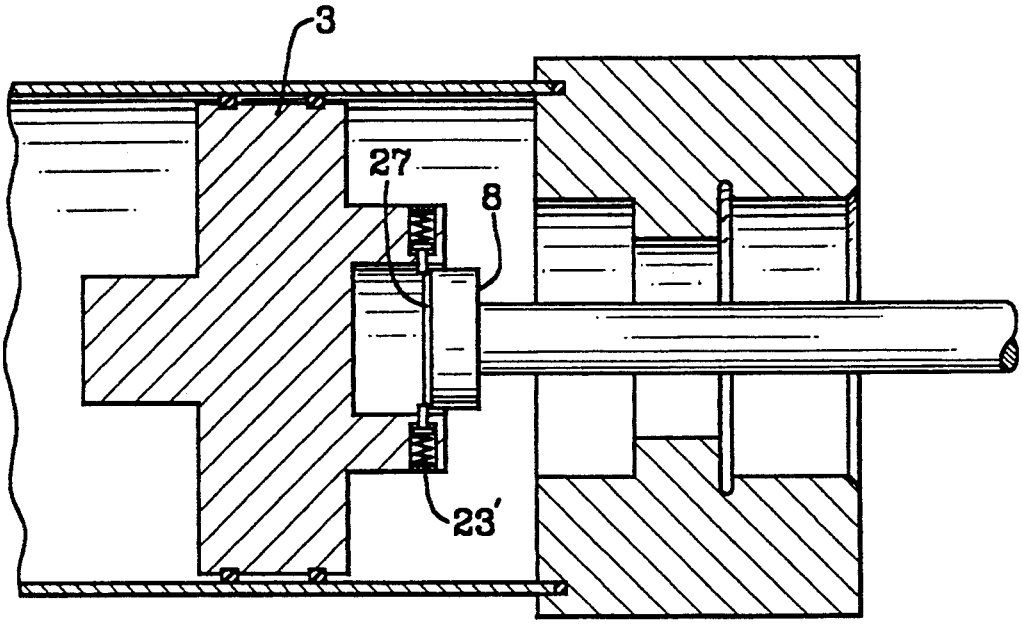
FIG. 5 is a cross section of an intensifier hydraulic system according to the present invention showing the water plunger in position for reinsertion within the hydraulic piston.

Upon removal, the plunger 4 may be serviced and reinserted in the piston as shown in FIG. 5. A bevel 27 provided on the plunger head 8 dilates the collet to permit entry of the plunger head into the bore 12 of the hydraulic piston 3. Once the plunger 4 is pushed all the way into the bore 12 the collet will snap shut by the spring action of the retainer spring 23 thereby again securing the water plunger to the hydraulic piston 3.

The cartridge seal 10 may then be reinstalled to complete the maintenance procedure. In this manner loss of substantial quantities of hydraulic fluid may be avoided particularly if the piston 3 is in the far right position or a drain is provided in the end cap to lower the hydraulic fluid level to below the seal 11 bore level.

What is claimed is:

1. An apparatus for releasably securing a piston rod to a piston comprising:

a piston having a socket formed therein for receiving an axially disposed piston rod;

said piston rod being provided with an expanded head having a diameter greater than said piston rod for cooperative insertion in said socket;

said socket being further provided with radially expanding retention means deployable behind said expanded head; and said radially expanding retention means being selectively releasable by a release means axially deployed along said piston rod from the end opposite said expanded head.

2. An apparatus for releasably securing a piston rod to a piston according to claim 1, wherein said expanded head of said piston rod is further provided with a means for displacing said radially expanding retention means in one insertion direction and a means for abutting said radially expanding retention means in a second removal direction.

3. An apparatus for releasably securing a piston rod to a piston according to claim 1, wherein said release means further comprises a cylindrical removal tool axially deployable concentrically about said piston rod from an end opposite said expanded head and being further provided with a beveled external end for radially displacing said radially expanding retention means upon axial deployment of said cylindrical removal tool into engagement with said piston and thereupon permit release of said piston rod from said piston.

4. An apparatus for releasably securing a piston rod to a piston according to claim 1, wherein said release means further comprises a cylindrical removal tool axially deployable concentrically about said piston rod and being further provided with a castle headed end for radially displacing said radially expanding retention means upon axial deployment of said cylindrical removal tool into engagement with and rotation thereof relative to said piston and thereupon permit release of said piston rod from said piston.

5. An apparatus for releasably securing a piston rod to a piston comprising:

a piston having a cylindrical socket formed therein for receiving an axially disposed piston rod;

said piston rod being provided with an expanded head having a diameter greater than said piston rod for cooperative insertion in said socket;

said socket being further provided with retention means deployable behind said expanded head for retaining said piston rod in said socket; and said retention means being selectively releasable by a release means axially deployed along said piston rod from the end opposite said expanded head.

* * * * *